United States Patent [19]

Mumby

[11] Patent Number: 4,550,392

[45] Date of Patent: Oct. 29, 1985

[54] APPARATUS FOR WELL LOGGING TELEMETRY

[75] Inventor: Edward S. Mumby, Carmichael, Calif.

[73] Assignee: Exploration Logging, Inc., Sacramento, Calif.

[21] Appl. No.: 355,921

[22] Filed: Mar. 8, 1982

[51] Int. Cl.[4] ..... H04H 9/00

[52] U.S. Cl. ..... 367/82; 367/83; 175/45

[58] Field of Search ..... 367/83, 85; 181/102, 181/110; 175/40, 45, 50; 33/306, 307; 340/853, 854

[56] References Cited

U.S. PATENT DOCUMENTS

| | | | |
|---|---|---|---|
| 2,521,976 | 9/1950 | Hays | 175/40 |
| 2,924,432 | 2/1960 | Arps et al. | 367/85 X |
| 3,302,457 | 2/1967 | Mayes | 367/83 X |
| 3,517,553 | 6/1970 | Williams et al. | 175/50 X |
| 3,765,494 | 10/1973 | Kielman | 175/45 X |
| 3,968,473 | 7/1976 | Patton et al. | 367/83 |
| 3,983,948 | 10/1976 | Jeter | 33/306 X |
| 4,120,097 | 10/1978 | Jeter | 175/45 |
| 4,130,169 | 12/1978 | Denison | 175/45 |
| 4,262,343 | 4/1981 | Claycomb | 367/83 |
| 4,351,037 | 9/1982 | Scherbatskoy | 33/307 X |
| 4,351,116 | 9/1982 | Scott, Jr. | 33/307 |
| 4,386,422 | 5/1983 | Mumby et al. | 175/50 |
| 4,468,762 | 8/1984 | Jurgens | 367/83 |

*Primary Examiner*—Charles T. Jordan
*Assistant Examiner*—Brian S. Steinberger
*Attorney, Agent, or Firm*—Christie,Parker&Hale

[57] ABSTRACT

Apparatus for sending pressure pulses through drilling fluid in a drill string in a well bore includes an assembly adapted to be lowered from the surface through the drill string to a position adjacent the lower end of the drill string. The external dimension of the assembly is substantially less than that of the internal diameter of the drill string, so there is always a substantial clearance between the assembly exterior and the drill string interior to permit a substantial flow of drilling fluid down the drill string, past the assembly, through a drill bit, and into an annular space between the drill string exterior and the well bore. The assembly includes an internal bore to permit drilling fluid to flow through the assembly. Means are provided for intermittently restricting flow of drilling fluid through the assembly bore to send the pressure pulses to the surface in response to the magnitude of a downhole condition to be measured. The assembly includes means to permit it to be retrieved by a wire line from the surface and without removing the drill string from the well bore.

19 Claims, 7 Drawing Figures

18
12
14
48
ELECTRONIC PROCESSING SYSTEM
SURFACE
46
44
20
40
22
DESURGER
41
24
38
MUD PUMP
26
16
43
36
27
42
28
10
30
30
32
34

APPARATUS FOR WELL LOGGING TELEMETRY

BACKGROUND OF THE INVENTION

1. Field of the Invention

This invention relates to logging wells during drilling, and more particularly to the wireless telemetry of data relating to downhole conditions.

2. The Prior Art

It has long been the practice to log wells by sensing various downhole conditions within a well and transmitting the acquired data to the surface through a wire line or cable-type equipment. To conduct such logging operations, drilling is stopped, and the drill string is removed from the well. Since it is costly and timeconsuming to remove the drill string, the advantages of logging while drilling, or at least without removing the drill string from the well bore, have long been recognized. However, the lack of an acceptable telemetering system has been a major obstacle to successful logging while drilling.

Various systems have been suggested for logging while drilling. For example, it has been proposed to transmit data to the surface electrically through wires. Such methods have been impractical because of the need to provide the drill string sections with a special insulated conductor and appropriate connections for the conductor at the drill string joints. If a steering tool is used for directional drilling, and is controlled by wires from the surface, the wires and tool must be withdrawn from the well before continuing drilling in the rotary mode. Other proposed techniques include the transmission of acoustical signals through the drill string. Examples of such telemetering systems are shown in U.S. Pat. Nos. 3,015,801 to Kalbfell and 3,205,477 to Richards. In those systems, an acoustical signal is sent up the drill string and frequency modulated in accordance with a sensed downhole condition.

Wireless systems have also been proposed using low-frequency electromagnetic radiation through the drill string, borehole casing, and the earth's lithosphere to the surface of the earth.

Other telemetering procedures proposed for logging while drilling use the drilling fluid within the well as a transmission medium. U.S. Pat. Nos. 2,759,143 and 2,925,251 to Arps and 3,958,217 to Spinnler disclose systems in which the flow of drilling fluid through the drill string is periodically restricted to send positive pressure pulses up the column of drilling fluid to indicate a downhole condition. U.S. Pat. Nos. 2,887,298 to Hampton and 4,078,620 to Westlake et al disclose systems which periodically vent drilling fluid from the drill string interior to the annular space between the drill string and the well borehole to send negative pressure pulses to the surface in a coded sequence corresponding to a sensed downhole condition. A similar system is described in U. K. patent publication No. 2,009,473 A (Scherbatskoy).

A general problem with using pressure pulsing equipment in a drill string to send information through the drilling fluid is that the pulse generators to date have been bulky and, therefore, impose a wasteful pressure drop in the drilling fluid flowing through the drill string. Moreover, the previous pulse generators require a relatively large amount of electrical power, which means short operating time if batteries are used, or else require expensive downhole electrical generators. The previous pulse generators are also subject to excessive wear, resulting in short service life and frequent failure under operating conditions.

In addition, the prior art pulse generators require specially built drill collars in the drill string to receive the generators and cannot reliably be positioned in the lower end of the drill string without removing the drill string from the well bore.

This invention provides a pressure pulse generator with long and reliable service life, and which can be quickly lowered into, or removed from, a standard drill string without removing the drill string from the well bore. The pulse generator of this invention does not require a special section of drill string or drill collar to permit the generator to operate. For example, in the rotary drilling mode, the pulse generator can be landed on a TOTCO ring made up in the drill string at the desired location. If drilling with a bit driven by a downhole motor (i.e., with the drill string not rotating), the pulse generator can be landed in a conventional muleshoe made up in the drill string to orient the generator relative to the face of the drill bit. Under some circumstances, the generator may simply be lowered in the drill string to rest on the drill bit. Another advantage of the pressure pulse generator of this invention is that when it is in operating position in the drill string, it offers a relatively low resistance to flow of drilling fluid.

The pulse generator of this invention can be used to measure many different downhole conditions, such as electrical resistivity, radioactivity, temperature, drilling fluid flow rate, weight on bit, torque, and the like. It is also well suited for directional survey work, i.e., determining the inclination and azimuth of a borehole. Such information is important for ascertaining that the well is being accurately drilled to a selected downhole position. With this invention, the pressure pulse generator can quickly and easily be lowered through the drill string to a position just above the drill bit so that the inclination and azimuth of the well bore, or any other downhole condition, can be measured and transmitted to the surface by generating pressure pulses in the drilling fluid.

Preferably, the pulse generator is retrievable from the drill string by the use of an overshot tool on a wire line operated from the surface. Thus, if the drill string sticks in the well bore, the pulse generator can be recovered, even if the lower portion of the drill string must be abandoned in the well.

SUMMARY OF THE INVENTION

The pressure pulse generator of this invention includes a retrievable assembly adapted to slide freely into and out of a drill string from the upper end of the drill string to a location near the lower end of the drill string while the drill string is in a well filled with drilling fluid circulated by a pump to flow through the interior of the drill string, past a drill bit on the lower end of the drill string, and into an annular space between the drill string and the well wall, and then to the surface.

The assembly includes a main valve housing with a main valve bore housing, an inlet, and an outlet through which a portion of the drilling fluid may flow. The bore inlet opens upstream into a high-pressure zone of the drilling fluid, and the bore outlet opens downstream into a low-pressure zone of the drilling fluid flowing through the drill string. The assembly is constructed and arranged so that a substantial portion of the drilling fluid always flows through a annular space between the assembly exterior and the drill string interior when the assembly is in the drill string. To this end, the exterior dimension of the assembly is substantially less than the interior dimension of the drill string, which also facilitates the assembly sliding freely into and out of the drill string.

The assembly includes means for generating a control signal responsive to a downhole condition and means responsive to the control signal to change the rate at which fluid flows through the main valve bore to send a pressure pulse through the drilling fluid to a pressure pulse detector at the upper end of the well.

Preferably, the invention includes means between the main valve bore inlet and outlet defining a flow restriction between the drill string interior and the main valve housing exterior to develop a substantial working pressure drop in the drilling fluid. The pressure drop powers the main valve to vary the flow rate of drilling fluid through the main bore. Latching means on the assembly permits it to be retrieved from the drill string by a corresponding latch attached to a wire line and operated from the surface without removing the drill string from the well bore.

In the preferred embodiment of the invention, the main valve housing carries an exterior outwardly extending removable flow restrictor sleeve between the inlet and outlet of the main bore in the housing so the sleeve creates the working pressure drop in the drilling fluid flowing through the annular space between the housing and the drill string. Flow restrictor sleeves of different sizes may be mounted on the main valve housing to produce the desired working pressure drop for various drilling conditions and measurements.

In another form of the invention, the flow restriction is provided by a drill string restrictor sleeve secured between adjacent sections of drill pipe or drill collar to extend into the drill string, but leave an annular flow space between the inner surface of the sleeve and the exterior of the main valve housing. Alternatively, both the drill string sleeve and the outwardly extending sleeve on the main housing can be used to provide the necessary pressure drop in the drilling fluid.

The preferred form of the invention includes a pilot valve, which requires relatively little electric power to operate, and which uses hydraulic power in the flowing stream of drilling fluid to actuate the main valve to vary the flow of drilling fluid through the main valve housing bore. The pilot valve may be a spool valve, which is actuated by a rotary solenoid or a gearhead motor. In another form, the pilot valve may be a needle valve type actuated by a linear solenoid.

BRIEF DESCRFIPTION OF THE DRAWINGS

DESCRIPTION OF SPECIFIC EMBODIMENTS

In the preferred embodiments of the invention, as described in detail below, pressure pulses are transmitted through a drilling fluid to send information from the vicinity of a drill bit on the lower end of a drill string in a well to the surface of the earth as the well is drilled. At least one downhole condition within the well is sensed, and a signal is generated to represent the sensed condition. The signal controls the bypass of the flow of drilling fluid around the drill bit to cause pressure pulses at the surface in a coded sequence representing the downhole condition.

Figure 1:
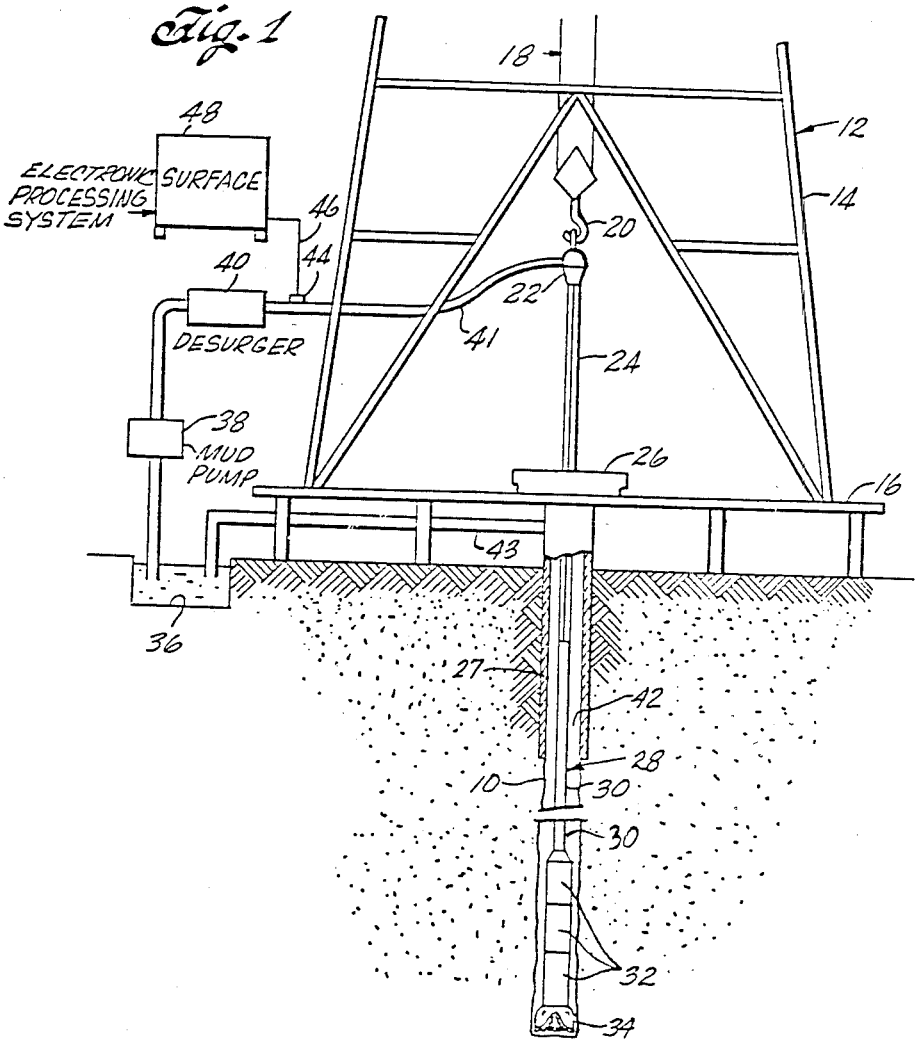
FIG. 1 is a fragmentary schematic elevation of a drilling rig and system for logging a well with a drill string in it.

Referring to FIG. 1, a well 10 is drilled in the earth with a rotary drilling rig 12, which includes the usual derrick 14, derrick floor 16, draw works 18, hook 20, swivel 22, kelly joint 24, rotary table 26, casing 27, and a drill string 28 made up of sections of drill pipe 30 secured to the lower end of the kelly joint 24 and to the upper end of a section of drill collars 32, which carry a drill bit 34. Drilling fluid (commonly called drilling mud in the field) circulates from a mud pit 36 through a mud pump 38, a desurger 40, a mud supply line 41, and into the swivel 22. The drilling mud flows down through the kelly joint, drill string and drill collars, and through nozzles (not shown) in the lower face of the drill bit. The drilling mud flows back up through an annular space 42 between the outer diameter of the drill string and the well bore to the surface, where it returns to the mud pit through a mud return line 43. The usual shaker screen for separating formation cuttings from the drilling mud before it returns to the mud pit is not shown.

A transducer 44 in the mud supply line 41 detects variations in drilling mud pressure at the surface. The transducer generates electrical signals responsive to drilling mud pressure variations. These signals are transmitted by an electrical conductor 46 to a surface electronic processing system 48, such as that described in U.S. Pat. No. 4,078,620.

Figure 2:
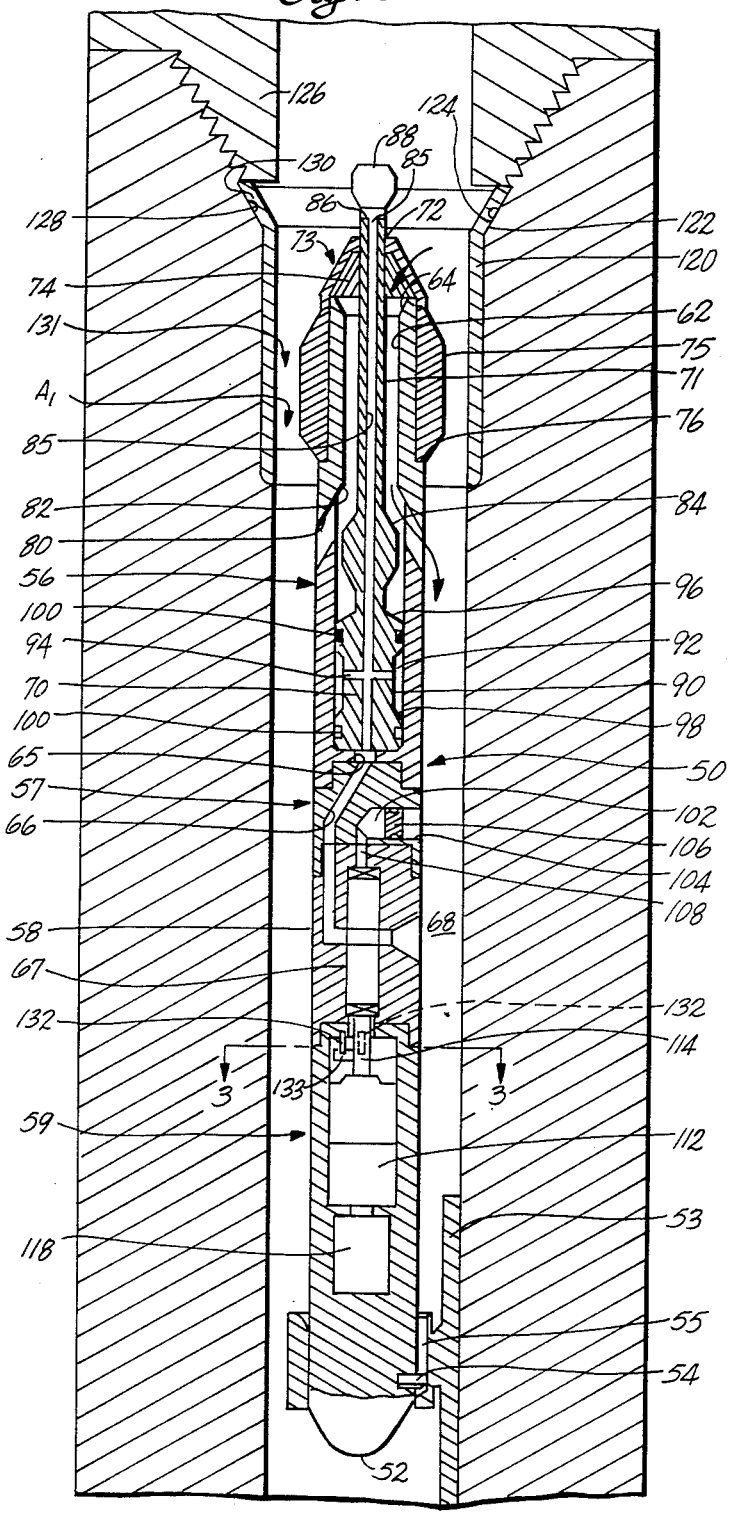
FIG. 2 is an enlarged schematic sectional elevation of one form of a pressure pulse generator made in accordance with this invention, and mounted in an operating position in the drill string.

Referring to FIG. 2, an elongated, vertical, cylindrical pressure pulse generator assembly 50 is mounted in a drill collar 32 so the lower end 52 of the assembly rests in a muleshoe 53 mounted inside the lower portion of the drill collar immediately above the drill bit. The muleshoe is of conventional construction, so it is not described in detail. Briefly, the assembly is oriented both longitudinally and rotationally in a fixed position with respect to the drill string by an outwardly extending pin 54, which rests in socket 55 of the muleshoe, which may be used to mount the assembly in a fixed orientation, such as when conducting directional drilling in the steering mode. Alternatively, the assembly may rest in a conventional TOTCO ring (not shown), if fixed orientation is unimportant.

The assembly includes an upper or main valve housing 56 secured to the upper end of a floating piston housing 57, the lower end of which is secured to the upper end of a pilot valve housing 58, the lower end of which is secured to the upper end of a control housing 59, which forms the lower end of the assembly.

Figure 4:
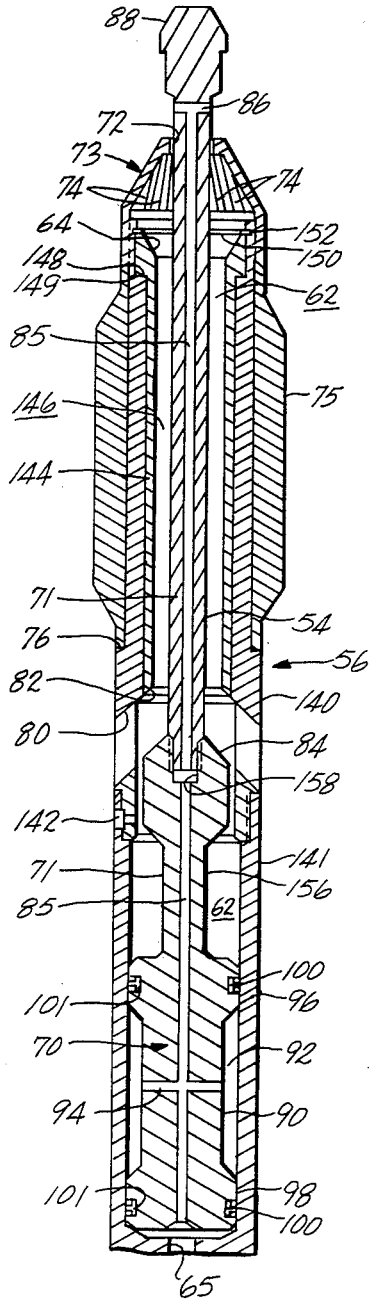
FIG. 4 is an enlarged longitudinal sectional view of the upper portion of the pressure pulse generator shown in FIG. 2.

As shown in FIGS. 2 and 4, a longitudinally extending, stepped main bore 62 opens out of the upper end of the main valve housing at an outwardly and upwardly extending inlet 64. The lower end of bore 62 is stepped down to a reduced diameter at 65 to form part of a control passage 66, which passes down through the floating piston housing, into the pilot valve housing, and horizontally through an elongated spool valve 67 mounted in the pilot valve housing to be rotatable about the longitudinal axis of the drill string. The lower end of the control passage opens out of the housing on the downstream side of the spool valve into the annular space 68 between the assembly exterior and the drill collar interior.

A main valve piston 70 is mounted to slide longitudinally in the lower portion of main bore 62. An upwardly extending main valve stem 71, formed integrally with the upper end of the main valve piston, extends out of the upper end of the main bore and through a central opening 72 in an upwardly and inwardly tapered cap 73 threaded at its lower end on the upper end of the main valve housing. The cap 73 includes a plurality of downwardly and outwardly extending slots 74 so that the cap acts as a screen for drilling fluid passing through it into the main bore 62.

An annular and outwardly extending restrictor sleeve 75 makes a close sliding fit around the upper end of the restrictor main valve housing, which is of reduced external diameter to form an outwardly and upwardly facing shoulder 76, on which the lower end of the restrictor sleeve rests. The lower end of the cap 73 bears against the upper end of the restrictor sleeve to hold it firmly in place. The sleeve is of increased diameter in its intermediate portion to form a restriction for drilling fluid flowing through the annular space between the sleeve and the interior of the drill collar.

Four downwardly and outwardly extending outlet ports 80 through the cylinder wall just below the restrictor sleeve connect the main bore 62 to the annular space between the housing and the drill collar. The outlet ports 80 are spaced at 90° intervals around the periphery of the housing, and only two of the outlet ports are shown in FIG. 2.

The main bore 62 is of reduced diameter just above the outlet ports 80 to form a downwardly and outwardly extending annular seat 82, which receives a downwardly and outwardly extending annular main valve plug 84 formed on the main valve stem above the valve piston in the vicinity of the outlet ports 80. A fluid passage 85, extending longitudinally from near the upper end of the main valve stem to open out the lower end of the valve piston, forms the upper end of the control passage 66. A transverse port 86 extends through the upper end of the main valve stem to admit drilling fluid from the drill string into the upper end of fluid passage 85. A latch knob 88 on the upper end of the valve stem permits the positive pulse generator to be retrieved from the surface without pulling the drill string from the well bore, as described below.

An intermediate section 90 of the main valve piston is of reduced diameter to form an annular lubricating space 92 between the valve piston and the housing bore. A transverse lubricating port 94 extends through the reduced section of the main valve piston to connect the annular lubricating space 92 with the upper fluid passage extending through the valve stem. Thus, the main valve piston includes upper and lower annular sealing portions 96 and 98, respectively, which make a close sliding fit within the lower end of the bore 62 in the housing. Each sealing portion includes an outwardly opening annular groove 100, which contains a suitable sealing ring 101 that makes a sliding hydraulic seal against the interior of the housing bore. Preferably, the annular space 92 between the two sealing rings 101 is packed with a suitable lubricant, such as grease (not shown). Thus, the valve stem is supported over a substantial span for accurate alignment within the housing bore, but presents a relatively small surface contact to minimize friction and power required to operate the valve. Lubricating port 94 connects the lubricant in space 92 to the higher pressure zone of the drilling fluid flowing past the assembly so that the lubricant pressure is always at least equal to that of the drilling fluid on the opposite sides of sealing rings 101.

The pilot spool valve is lubricated by oil from a reservoir 102 formed in a horizontal lubricating bore 104 opening out of the floating piston housing below the main valve bore. A floating pressure compensation piston 106 makes a sliding seal within bore 104 so that oil in the reservoir is kept at the same pressure as the drilling fluid surrounding the assembly. A lubricating port 108 leads from the oil reservoir to lubricate the spool valve body, as described in more detail below with respect to FIG. 6. The lubricating port 108 also supplies lubricating oil to the control housing at the lower end of the assembly, also described in more detail below with respect to FIG. 6.

A reversible electric gearhead motor 112 mounted in the control housing rotates a shaft 114 connected to the pilot spool valve 67 so the control passage 66 may be opened and closed in response to electrical signals generated by a downhole sensor and power supply 118 mounted in the control housing below the gearhead motor. The sensor can be of any suitable type for measuring downhole conditions to be monitored and reported to the surface while the drill string is in the well bore. For example, the sensor can be of the type which indicates well bore inclination and azimuth. The sensor and power supply include all the necessary circuitry, which is not shown or described in detail because it forms no part of the present invention.

A drill collar insert sleeve 120 makes a close fit against the inner surface of the drill collar in which the housing is mounted. The drill collar insert sleeve includes an upwardly and outwardly extending annular flange 122, which rests on an upwardly and outwardly extending annular shoulder 124 formed in the upper end of the internally threaded box 125 of the drill collar in which the housing is mounted. The drill collar insert sleeve flange is held clamped in place by the lower end of an externally threaded drill collar pin 126 threaded into the box 125. An annular O-ring 128 in an outwardly and downwardly opening annular groove 130 in the drill collar insert flange 5 makes a fluidtight seal against seat 124. The insert sleeve surrounds the restrictor sleeve and has an internal diameter substantially larger than the maximum external diameter of the restrictor sleeve. This ensures that the assembly can easily slide through the insert sleeve, and that there is always a substantial annular space 131 of cross sectional area $A_1$ open for flow of drilling fluid down the drill string and out the drill bit.

Although the drill collar insert sleeve 120 is not essential, it is desirable, because it protects the drill collar against wear in the area where the restrictor sleeve extends out into the annular space between the housing and the drill collar. Moreover, it provides a precise internal diameter opposite the restrictor sleeve so that the cross sectional area $A_1$, through which drilling fluid flows past the restrictor sleeve, is accurately known. This facilitates formation of more uniform pressure pulses for transmission to the surface through the drilling fluid. However, the drill collar insert sleeve may be omitted. For example, an unexpected need for the pressure pulse generator of this invention might arise in a well already drilling with conventional drill collars assembled without the sleeve in place. Downhole information can still be obtained by simply lowering the pressure pulse generator of this invention into the drill string until the lower end of the assembly rests in the muleshoe, or, if no muleshoe is present, on the upper end of the drill bit, or on a conventional "TOTCO" ring placed in the drill string just above the drill bit. In the latter two cases, the assembly may not be exactly collinear with the drill string, or rotationally oriented (if a TOTCO ring is used to receive the assembly), but useful information can still be obtained, because the exterior restrictor sleeve provides the necessary pressure drop to operate the main valve as described below.

With the pressure pulse generator mounted in the drill string, as shown in FIG. 2, information is sent to the surface by operation of the pilot spool valve in accordance with electrical signals transmitted in a coded sequence to the gearhead motor which opens and closes the pilot valve intermittently.

With the pilot valve open, as shown in FIG. 2, drilling fluid flows down through the main valve bore 62 in the main valve housing and also down through the annular space between the assembly and the drill string. Because of the restricted cross sectional area $A_1$ of the annular space in the vicinity of the restrictor sleeve, the pressure ($P_1$) in the drilling fluid at the main valve bore inlet is higher than the pressure ($P_2$) at the outlets 80. When the gearhead motor receives an appropriate signal from the downhole sensor, the motor rotates the spool valve to close it. This applies the higher pressure $P_1$ upstream of the restrictor sleeve to the bottom of the valve stem piston, causing the valve stem to rise until the main valve plug rests against the annular seat 82, thus closing the main valve bore and causing all drilling fluid to flow in the annular space $A_1$, the effective flow cross sectional area of which remains unchanged. This diversion of the drilling fluid generates a positive pressure pulse in the drilling fluid, which is transmitted to the surface and detected by the surface sensor 44.

The effective cross sectional area of the main valve plug exposed to the upstream pressure when the plug bears against seat 82 is smaller than the effective cross sectional area of the bottom of the main piston exposed to the upstream pressure of the drilling fluid, thus creating a net upward force on the valve plug and keeping it in the closed position until the pilot spool valve is opened.

When the gearhead motor receives an appropriate signal from the downhole sensor, it turns in the opposite direction and restores the pilot spool valve to the open condition shown in FIG. 2. This vents the higher pressure drilling fluid into the lower pressure of the annular space below the exterior housing sleeve, permitting the main valve piston to travel downwardly and thus open the main valve outlet ports 80 to return to normal the pressure of the drilling fluid at the surface, which is detected by surface sensor 44.

Figure 3:
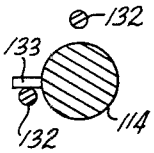
FIG. 3 is an enlarged view taken on line 3—3 of FIG. 2.

The gearhead motor is driven in the required direction by a programmed pulse of electrical energy adequate to move the valve between the opened and closed positions. A pair of stops 132 secured to the lower end of the pilot valve housing extend downwardly into the path of a travel limit tab 133 (FIG. 3) secured to pilot valve shaft 114 to engage one or the other of the stops when the spool valve is in the closed or open position to prevent inadvertent travel of the spool beyond the required position.

After the logging operation is complete, the positive pulse generator housing is removed from the well bore by lowering an overshot tool (not shown) down on a wire line until it engages a latch means 88 on the upper end of the valve stem. The housing is then lifted with the wire line from the well, and drilling can resume with virtually no extraneous restriction to flow through the drill string, other than the negligible amount which might be imposed by the thin-walled drill collar insert sleeve, if used. Moreover, the assembly can quickly and easily be placed in the drill string for logging while the drill string is in the well bore by simply dropping the assembly down the drill string from the surface. Alternatively, the assembly can be lowered into the drill string on a wire line with a releasable latch.

As shown more clearly in FIG. 4, the main valve housing 56 includes an upper cylindrical section 140 threaded at its lower end into the upper end of a lower cylindrical section 141. A set screw 142 locks the upper and lower sections together to form the main valve housing 56 of the assembly 50. Alternatively, the sections may be secured together by threaded connections (not shown).

An internal sleeve 144 makes a close fit in bore 62 in the upper section of the main valve housing. The internal diameter of the sleeve 144 is substantially greater than the external diameter of the main valve stem 71 and, therefore, leaves an annular space 146 with a cross sectional area $A_2$ substantially less than $A_1$, that is, the annular space between the exterior of the exterior housing sleeve 75 and the interior diameter of the drill collar sleeve 120. The difference in the two cross sectional areas required to produce the pressure drop needed to operate the main valve will depend on the equipment used to drill the well, and on drilling conditions. In a typical drilling operation, where the drilling fluid is pumped through the drill string at the rate of about 200 gallons per minute, $A_1$ may be about 0.83 sq. in., and $A_2$ about 0.60 sq. in. If the flow rate of the drilling fluid is substantially higher, say, about 600 gallons per minute, $A_1$ may be about 1.0 sq. in., and $A_2$ about 0.6 sq. in. Under these conditions, the pressure drop in the drilling fluid between the main valve housing inlet and outlet is between about 50 and about 200 psi, which is adequate to operate the main valve in response to actuation of the pilot valve.

The assembly will also transmit pulses through the drilling fluid, even when the pressure drop is insufficient to operate the main valve. For example, under relatively quiescent conditions, say, when drilling fluid is circulated slowly and no drilling is underway, operation of only the pilot valve generates a sufficient pulse to be detected at the surface because of low background noise. Under these quiescent conditions, a detectable pulse may be well below 50 psi, say, about 20 psi.

The lower end of internal sleeve 144 tapers downwardly and outwardly to form the seat 82 which receives the tapered plug 84 on the main valve stem. The upper end of the flow sleeve tapers upwardly and outwardly to form the inlet 64 for the main valve bore 62. The upper end of the flow sleeve 144 also includes an outwardly extending and downwardly facing annular shoulder 148, which rests on an annular shoulder 149 formed adjacent the upper end of the internal flow sleeve. A C-shaped snap ring 150 fits in an inwardly opening annular groove 152 at the upper end of the upper section of the main valve housing and holds the internal flow sleeve in place. Thus, the flow sleeve can be easily and quickly replaced as needed due to wear, or to change the cross sectional area of annular space 146 ($A_2$) to provide the desired operating characteristics for the pressure pulse generator under different operating conditions.

To facilitate servicing the assembly, the valve stem is made up of an upper section 154, the lower end of which is threaded into the upper end of a lower section 156 in an internally threaded bore 158 in the central portion of the upper surface of main valve plug 84. Flow control passage 85 is made up of collinear bores extending through the upper and lower sections of the main valve stem sections.

As indicated above, the effective cross sectional area of the valve plug 84 when it is seated in seat 82 is less than the effective cross sectional area of the lower surface of the main valve piston, so that when the main valve is moved to the closed position, it is held there because of the greater force on the underside of the main valve piston than on the upper side.

Figure 5:
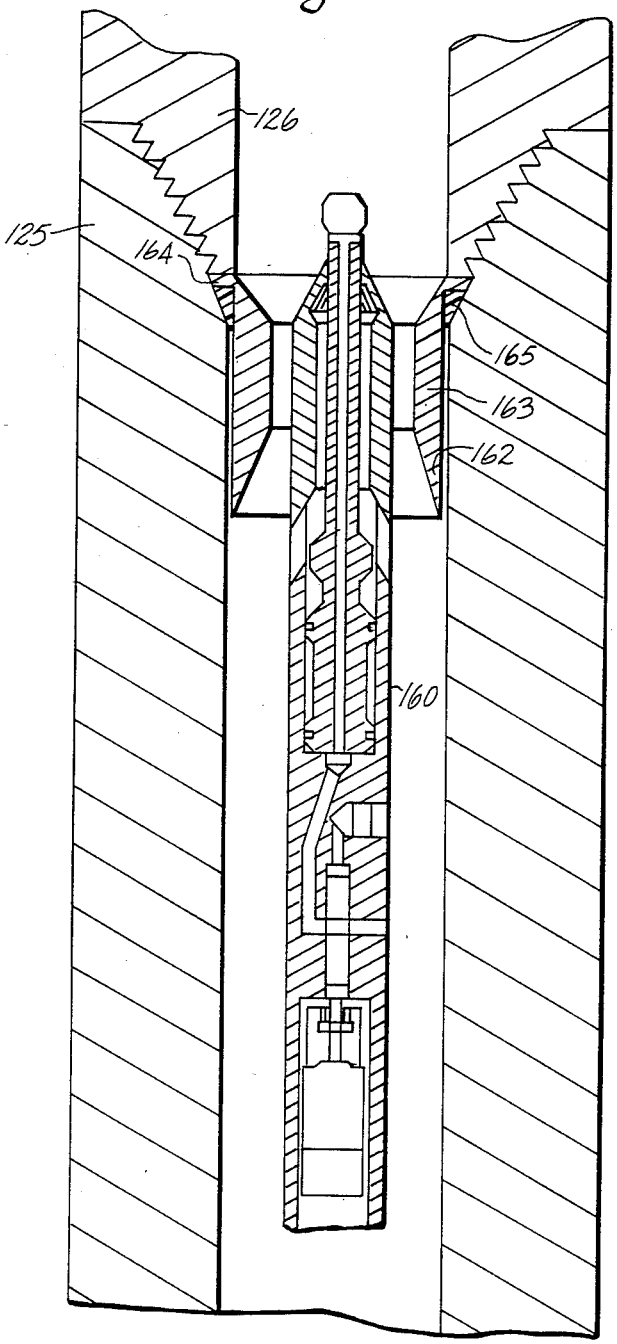
FIG. 5 is a fragmentary schematic sectional elevation of another embodiment of a pressure pulse generator made in accordance with this invention.

The embodiment shown in FIG. 5 is similar to that of FIG. 2, except that the main valve housing 160 has a uniform diameter for substantially its entire length, the exterior housing sleeve of FIGS. 2 and 4 being omitted. A drill collar insert sleeve 162 is mounted between adjacent ends of drill collar sections similar to that shown in FIG. 2, except that insert sleeve 162 has a central section 163 of increased thickness intermediate its ends to provide the required restriction to flow of drilling fluid past the main valve housing exterior between the main valve bore inlet and outlet.

Insert sleeve 162 includes an outwardly extending annular flange 164, which rests on an annular rubber seal 165 which makes a snug fit around the exterior of the insert sleeve. The lower end of seal 165 includes a downwardly and inwardly extending annular portion 166, which rests on a matching surface 167 formed in the box 125 of the drill collar. The lower end of the externally threaded pin 126 bears against the upper surface of flange 164 to hold insert sleeve 162 firmly in place and squeeze the rubber seal to prevent drilling fluid from leaking past the exterior of the sleeve.

The advantage of the embodiment shown in FIG. 5 is that the assembly is of reduced diameter for its entire length so it will sink faster and more freely through the drilling fluid and drill string when the assembly is lowered into the drill string from the surface. However, if the drill collar insert sleeve 162 is used, it is made up into the drill string at the surface before the drill string is lowered into the well bore, and the drill collar insert sleeve offers some resistance to drilling fluid flow, even after the pressure pulse generator is removed by the wire line retrieval tool.

The relative sizes of the cross sectional area $A_1$ of the annular space between the main valve housing exterior and the drill string interior, and the annular area $A_2$ between the main valve stem and the housing interior, is critical to the extent that the pressure drop between the inlet and outlet of the main valve must be sufficient to actuate the main valve when the pilot valve is closed. Over a wide range of operating conditions, a pressure drop in the range of 20 to 100 psi has proved adequate. Preferably, the outer annular area is substantially greater than the inner annular area so that when the inner annular area is closed, enough drilling fluid continues to pass down the drill string for normal drilling operations and without imposing an unacceptable pressure increase in the drilling fluid. With this invention, it is relatively easy to design the equipment so that the pressure surge when the main valve is closed does not exceed about 200 psi, which is well within the safety limits of most equipment, and yet produces a pressure pulse of adequate amplitude to be detected at the surface.

Figure 6:
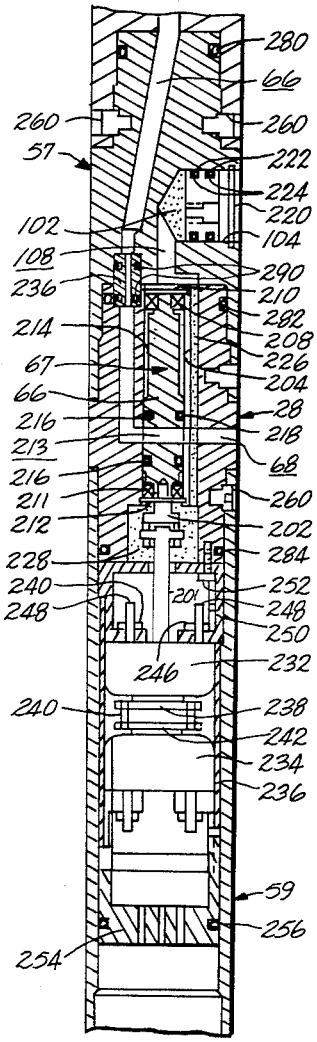
FIG. 6 is an enlarged schematic sectional view of the lower portion of the pressure pulse generator shown in FIG. 2, using a rotary solenoid actuator to control a pilot spool valve.

FIG. 6 shows the pilot spool valve 67 in more detail and mounted to be operated by a rotatable solenoid shaft 201 secured at one end to a solenoid coupling 202, which is screwed into the lower end of the pilot spool valve 67 mounted to rotate about the longitudinal axis of the well bore in a pilot valve housing bore 204 in the pilot valve housing 58. The upper end of the pilot valve is of reduced diameter and journaled in an upper bearing 208 secured in the pilot spool valve housing bore by a snap ring 210. The lower end of the pilot valve is of reduced diameter and journaled to rotate in a lower bearing 211 secured in the pilot valve bore by a snap ring 212. The portion of the pilot spool valve plug in the vicinity of the transverse portion of the control passage 66 is of a diameter to make a close sliding fit in the spool valve housing bore and contains a valve port 213, so the control passage 66 can be opened and closed by operation of the rotatable solenoid shaft. The remainder of the pilot spool valve is of reduced diameter to leave an annular clearance 214 between it and the pilot housing bore 204, so that lubricating oil can flow from the reservoir 102 past the upper bearing into the annular space between the pilot spool valve plug and the spool valve housing bore. The lubricating oil and drilling fluid are kept separate by O-rings 216 mounted in respective annular grooves 218 in the spool valve body on opposite sides of the port 213.

A snap ring 220 in the bore 104, which forms the reservoir 102, keeps the pressure compensation piston 106 captive in bore 104. O-rings 222 in annular grooves 224 in the pressure compensation piston make a sliding fit in bore 104 to keep the drilling fluid and lubricating oil separated.

Lubricating oil is also supplied from reservoir 102 through a longitudinally extending lubricating passage 226, which opens into an enlarged bore 228 in the spool valve housing around the solenoid coupling, so that lubricating oil is also supplied to the lower bearing. Lubricating oil also flows into the control housing 59, which holds an upper rotary solenoid 232 and a lower rotary solenoid 234 mounted in a solenoid cartridge 236, which makes a snug fit inside the control housing. A face plate 238 of the upper solenoid is secured by a face plate coupling 240 to a face plate 242 of the lower solenoid. The rotatable solenoid shaft 201 is secured by conventional means (not shown) to the upper face plate so that when either of the solenoids is actuated, the solenoid shaft travels longitudinally a short distance, say, 0.040", and rotates 45° so the pilot spool valve port 212 may be turned into and out of communication with control passage 66.

Each solenoid is secured to a pair of U-shaped headers 244 by nuts 246 threaded onto mounting screws 248 carried by the solenoids. Screws 250 secure the solenoid headers to the solenoid cartridge, and screws 252 secure the solenoid headers to the pilot valve housing.

The right end of the control housing is closed by an electrical feed-through plug 254, which includes an O-ring 256 that makes a fluidtight seal against the control housing interior. Electrical leads (not shown) pass from the downhole sensor and power supply 118 (FIG. 2) in the lower portion of the control housing up to the upper and lower solenoids, where they are connected in a conventional manner.

Thus, the upper solenoid may be momentarily energized in response to a signal from the downhole sensor to drive the upper face plate upwardly, causing the solenoid shaft to rotate 45° from the position shown in FIG. 6, and thereby close the control passage 66. This causes the main valve plug to move up and close the main valve bore outlet, as previously described.

The pilot spool valve is returned to the open position shown in FIG. 6 by momentarily energizing the lower solenoid to drive the lower face plate coupling down, causing the solenoid shaft to rotate 45° in the opposite position and align port 213 with the control passage 66.

The upper end of the pilot valve housing 58 makes a slip fit into the lower end of the floating piston housing 57, the upper end of which makes a slip fit into the lower end of the main valve housing 56. The lower end of the pilot valve housing makes a slip fit into the upper end of the control housing 59. The housings are secured against rotational and longitudinal movement where they are coupled together by screws 260.

The control passage 66 is simply a series of aligned bores which extend through the main valve housing, and the floating piston housing, and the pilot valve housing. An O-ring 280 makes a fluidtight seal between the main valve housing and the floating piston housing. An O-ring 282 makes a fluidtight seal between the floating piston housing and the pilot valve housing, and an O-ring 284 seals the lower end of the pilot valve housing to the upper end of the control housing.

A crossover tube 286 in the control passage 66 at the junction of the lower end of the floating piston housing and the pilot valve housing carries a pair of O-rings 290, which prevent drilling fluid leaking from the lower fluid passage and into the lubricating oil supply.

Figure 7:
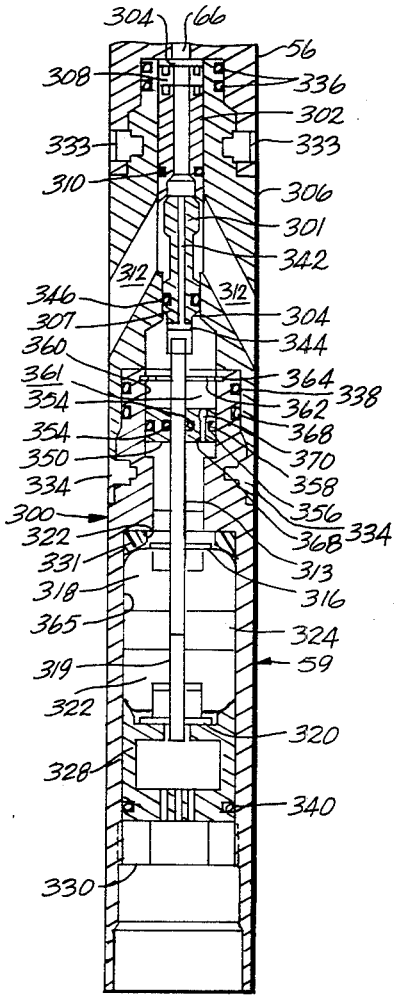
FIG. 7 is a fragmentary schematic sectional elevation of the lower portion of the pressure pulse generator of FIG. 2, using a linear solenoid actuator to control the pilot plug valve.

In the embodiment shown in FIG. 7, a linear solenoid actuator 300 reciprocates a pilot plug valve 301 to open and close the control passage 66, which opens from the lower end of the main valve housing 56 into a flow control orifice 302 threaded into a longitudinal bore 304 in a pilot valve housing 306. The pilot valve plug 301 includes a piston 307 mounted to slide in bore 304 below the lower end of the flow control orifice 302. A locknut 308 threaded into the upper end of bore 304 secures the flow control orifice against longitudinal movement. An O-ring 310 makes a hydraulic seal between the orifice and the bore 304. The lower end of bore 304 opens into downwardly and outwardly extending exit channels 312, which open at their outer ends into the annular space between the assembly and the drill string.

The lower end of the pilot valve plug is threaded onto the upper end of an upper solenoid shaft 313 secured to a face plate of armature 316 in an upper or opening solenoid 318. The lower end of the upper solenoid shaft bears against the upper end of a lower solenoid shaft 319 secured to a face plate or armature 320 in a lower or closing solenoid 322.

The solenoids are spaced apart by a solenoid spacer block 324 and are held in the control housing 59 by an electrical feed-through plug 328 held compressed against the underside of the lower solenoid by a locknut 330 threaded into the interior of the control housing. The upper end of the upper solenoid bears against an annular rubber shock mount 331, which bears against an inwardly extending and downwardly facing annular shoulder 332 in the control housing.

The upper end of the pilot valve housing makes a slip fit into the lower end of the main valve housing, and they are secured together against relative rotational or longitudinal movement by screws 333. The upper end of the control housing makes a slip fit into the lower end of the pilot valve housing, and they are secured together against relative rotational or longitudinal movement by screws 334. O-rings 336 make a fluidtight seal between the main valve housing and the pilot valve housing. O-rings 338 make a fluidtight seal between the pilot valve housing and the control housing. O-ring 340 makes a fluidtight seal between the electrical feed-through plug and the solenoid housing.

A longitudinal bore 342 extends from the upper end of the pilot valve plug 301 to a crossbore 344, which extends through the lower end of the pilot valve plug. An O-ring 346 makes a sliding fluidtight seal between the pilot valve plug piston 307 and bore 304.

A floating piston 350 makes a close slip fit around an intermediate portion of the upper solenoid shaft 313. An inwardly opening annular groove 352 on the interior face of the annular floating piston holds an O-ring 354, which makes a sliding fluidtight seal against the upper solenoid shaft. An annular outwardly opening groove 356 in the outer face of the floating piston contains an O-ring 358, which makes a sliding fluidtight seal against the inner wall 360 of a portion 361 of bore 304 of enlarged cross sectional area. A C-shaped snap ring 362 adjacent the upper end of enlarged bore section 361 fits in an inwardly opening annular groove 364 to keep the floating piston captive in bore section 361.

The floating piston includes a threaded bore 368 extending through it and which is closed by a removable plug 370 threaded into bore 368. Before the linear solenoid actuator shown in FIG. 7 is assembled in final position, the space below the floating piston is filled with lubricating oil by removing the plug 370, evacuating the space below the floating piston, and filling the evacuated space with oil. Thereafter, the plug 370 is threaded into the position shown in FIG. 7. This ensures that the linear solenoids in the control housing are bathed in oil at all times and protected from contamination with drilling fluid. Moreover, the floating piston keeps the lubricating oil at ambient pressure so that there are no large pressure differentials exerted on the various elements in the control housing.

With the pilot valve plug 301 in the open position shown in FIG. 7, pressure $P_2$ on the downstream side of the flow restrictor between the assembly and the drill string is applied through bore 342 to the underside of the pilot valve plug 301, and the pilot valve remains open.

To create a pressure pulse in the drilling fluid, the lower or closing solenoid 322 is actuated by a suitable signal applied through the electrical feed-through plug, causing the solenoid shafts to move upwardly so the pilot valve plug closes the lower end of the flow control orifice 302. In effect, the portion of bore 304 below exit channels 312 and the space in the solenoid housing above feedthrough plug 328 form a chamber to hold fluid which works against the bottom of piston 307. This causes the pressure $P_1$ on the upstream side of the flow restrictor to be applied to the underside of the pilot valve plug piston, moving the piston and plug up to close the orifice. Once the orifice is closed, the closing solenoid is de-energized, and the pilot valve plug is held up against the flow control orifice because the effective area of the upper end of the plug exposed to pressure $P_1$ is smaller than the effective area of the lower end of the plug exposed to the same pressure. Thus, the net upward force on the plug holds it in the closed position.

To open the pilot valve, the opening solenoid is energized, causing the solenoid shafts to move downward and pull the pilot valve plug away from the lower end of flow control orifice 302, and permitting the pressure on the underside of the plug to return to $P_2$. The plug now stays in the lower position, and the opening solenoid is deenergized.

The gearhead motor (FIG. 2) for opening and closing the pilot valve has the advantage that it is more energy-efficient than either of the two solenoid systems shown in FIGS. 6 and 7. However, the solenoid systems are rugged and, in some respects, more trouble-free than motor operation, and therefore their use may be preferred in those situations where more rugged operating conditions are encountered, and energy efficiency is less important.

As will be apparent from the foregoing description, the advantage of the present invention is that the assembly which generates the positive pulse in the drilling fluid can be lowered into, and removed from, a drill string without having to pull the drill string from the well bore. This greatly facilitates and expedites logging downhole information. Moreover, the embodiment of the invention which includes the external restrictor on the assembly permits the assembly to be placed in any position in the drill string, and useful information sent to the surface from that point. For example, the assembly may be supported on a wire line halfway down the drill string to run a neutron gamma ray log without having to pull the drill string from the well bore. In other words, useful information can be obtained from anyplace within the drill string where the assembly may be suspended.

In addition, by having the pulse generator assembly of this invention control only a minor portion of the total fluid flow, better operating results and longer service life are achieved. For example, closing the main valve in the assembly completely and relatively quickly generates a sharp, reproducible pressure pulse, which is more easily identified over background noise than in those prior-art systems where the flow of the entire volume of the fluid flow is only partially restricted. In addition, the complete closing of the main valve in the assembly prolongs its service life far beyond those prior-art systems where an orifice is only partly closed, leaving adjacent surfaces of movable parts subject to intense abrasion and erosion.

I claim:

1. Apparatus for sending information to a surface pressure pulse detector through drilling fluid in a borehole drilled in the earth with a drill bit on the lower end of a drill string in the borehole and through which the drilling fluid is circulated to flow through the interior of the drill string, past the drill bit, and into an annulus between the drill string and the borehole wall, the apparatus comprising:

a retrievable assembly adapted to slide into and out of the drill string from the upper end of the drill string to a location near the drill bit, the assembly having a main bore with an inlet and an outlet through which a portion of the drilling fluid which flows through the drill string and past the drill bit may flow, the assembly being constructed and arranged so a first portion of the drilling fluid which flows through the drill string and past the drill bit may flow through the bore and a second portion of drilling fluid may flow through a substantially fixed flow cross sectional area between the assembly exterior and the drill string when the assembly is in the drill string;

means for generating a control signal responsive to a downhole condition; and means responsive to the control signal to change the rate at which drilling fluid flows through the bore and without changing the effective cross sectional area for fluid flow between the assembly exterior and the drill string to send a pressure pulse through the drilling fluid to the surface pressure pulse detector.

2. Apparatus according to claim 1 in which the cross sectional area for fluid flow between the assembly exterior and the drill string is substantially greater than that of the assembly bore.

3. Apparatus according to claim 1 or 2 which includes means between the assembly bore inlet and outlet defining a flow restriction between the drill string interior and the assembly exterior to create a working pressure drop in the drilling fluid between the bore inlet and outlet, and means responsive to the pressure drop to change the rate at which drilling fluid flows through the assembly bore.

4. Apparatus according to claim 1 or 2 which includes latching means on the assembly to permit it to be retrieved from the drill string by a wire line from the surface without removing the drill string from the well bore.

5. Apparatus according to claim 4 in which the latching means is constructed and arranged to receive an overshot tool secured to a wire line.

6. Apparatus according to claim 1 or 2 which includes a valve for opening and closing the assembly bore in response to the signal.

7. Apparatus according to claim 1 which includes a main valve for changing drilling fluid flow rate through the bore, and a pilot valve responsive to the control signal for actuating the main valve.

8. Apparatus according to claim 7 in which the main valve is powered by the pressure drop in the drilling fluid flowing through the drill string.

9. Apparatus according to claim 7 or 8 which includes a rotary solenoid for operating the pilot valve.

10. Apparatus according to claim 7 or 8 in which the pilot valve is a spool valve, and which includes an electric motor for operating the spool valve.

11. Apparatus according to claim 10 in which the electric motor is reversible.

12. Apparatus according to claim 11 which includes stop means for limiting the travel of the electric motor when moving the spool valve between the open and the closed portions.

13. Apparatus according to claim 7 or 8 in which the pilot is opened and closed by linear movement of a valve plug, and a linear solenoid for moving the plug.

14. Apparatus according to claim 1 or 2 which includes an outwardly extending sleeve on the assembly between the main bore inlet and outlet.

15. Apparatus according to claim 14 in which the sleeve is removable from the assembly.

16. Apparatus according to claim 1 or 2 which includes a replaceable sleeve mounted in the drill string at a location between the assembly bore inlet and outlet when the assembly is positioned in the drill string to send pressure pulses through the drilling fluid.

17. Apparatus according to claim 16 in which the drill string is made up of a series of pipe sections threaded together at adjacent ends, and an outwardly extending flange on the sleeve clamped between two adjacent ends of pipe sections.

18. Apparatus according to claim 16 in which the sleeve includes an inwardly extending portion to create a flow restriction between the inlet and outlet of the main bore in the assembly.

19. Apparatus according to claim 1 or 2 which includes a replaceable interior sleeve in the assembly bore.

* * * * *